United States Patent [19]

Optiz et al.

[11] 4,073,871

[45] Feb. 14, 1978

[54] JOINT COMBUSTION OF OFF-GASES AND LIQUID RESIDUES CONTAINING CHLORINATED HYDROCARBONS WITH HYDROCHLORIC ACID RECOVERY

[75] Inventors: Wolfgang Optiz, Hurth-Alstadten; Hans Hennen, Hurth, both of Germany

[73] Assignee: Hoechst Aktiengesellschaft, Frankfurt am Main, Germany

[21] Appl. No.: 777,718

[22] Filed: Mar. 15, 1977

[30] Foreign Application Priority Data

Mar. 19, 1976 Germany ..... 2611671

[51] Int. Cl.[2] ..... C01B 7/08

[52] U.S. Cl. ..... 423/481; 423/240; 423/210; 23/277 R; 23/284; 431/5; 431/181; 239/422; 239/424

[58] Field of Search ..... 423/240, 210, 481, 488; 23/277 R; 431/5, 6, 9, 11, 181, 187, 188; 110/7 R, 18 C; 239/422, 423, 424

[56] References Cited

U.S. PATENT DOCUMENTS

| | | | |
|---|---|---|---|
| 3,192,920 | 7/1965 | See et al. | 239/428 |
| 3,445,192 | 5/1969 | Woodland | 423/481 |
| 3,748,082 | 7/1973 | Ivernel | 239/422 |
| 4,014,654 | 3/1977 | Howell | 431/187 |
| 4,018,879 | 4/1977 | Winnen | 423/240 |

FOREIGN PATENT DOCUMENTS

| | | | |
|---|---|---|---|
| 1,070,515 | 6/1967 | United Kingdom | 423/488 |
| 1,350,727 | 4/1974 | United Kingdom | 423/240 |
| 172,755 | 12/1921 | United Kingdom | 431/187 |

*Primary Examiner*—O. R. Vertiz
*Assistant Examiner*—Brian E. Hearn
*Attorney, Agent, or Firm*—Connolly and Hutz

[57] ABSTRACT

Off-gases and liquid residues containing chlorinated hydrocarbons, are subjected to joint combustion by forming a mist comprising a mixture of off-gases and atomized liquid residues, the latter being atomized by means of air and/or steam, and directing this mist into a preheated combustion chamber lined with refractory bricks. The mixture is introduced into the combustion chamber jointly with combustion air through a burner having four feed pipes arranged coaxially with respect to each other and terminating in conically tapered outlets, the three outer feed pipes defining three separate and coaxial annular zones around the innermost feed pipe. The liquid residue fed in and burnt is used in a quantity sufficient to maintain in the combustion chamber a predetermined maximum temperature which is not above the range 1200° to 1800° C, and which is compatible with the refractory properties of the brick lining of the combustion chamber. The resulting hot combustion gases are withdrawn from the combustion chamber, quenched with water, and hydrochloric acid is recovered from the resulting aqueous solution.

9 Claims, 2 Drawing Figures

JOINT COMBUSTION OF OFF-GASES AND LIQUID RESIDUES CONTAINING CHLORINATED HYDROCARBONS WITH HYDROCHLORIC ACID RECOVERY

This invention relates to the joint combustion of off-gases and liquid residues containing chlorinated hydrocarbons, with the formation of HCl.

In the commercial production of e.g. vinyl chloride, chlorinated hydrocarbons, which may be gaseous or liquid, are being obtained in larger and larger quantities. These are toxic hydrocarbons, and they are commonly converted into carbon dioxide, water and hydrogen chloride in an incinerator. Off-gases containing chlorinated hydrocarbons are formed in various commercial installations and are obtained in qualitatively and quantitatively widely varying proportions, whereby incineration is rendered difficult. Technically less difficult to achieve is the incineration of liquid residues of chlorinated hydrocarbons, which can be uniformly mixed and delivered from a reservoir to the incinerator. This is the reason why the methods used heretofore in the present field relate to the incineration of liquid chlorinated hydrocarbons, which may be effected in conjunction with the recovery of hydrochloric acid or dry hydrogen chloride.

It is therefore an object of the present invention to provide a process permitting off-gases containing chlorinated hydrocarbons to be incinerated jointly with liquid residues containing chlorinated hydrocarbons.

Heretofore, it has been a normal practice to effect the incineration of off-gases containing chlorinated hydrocarbons and that of liquid residues containing chlorinated hydrocarbons in two combustion chambers, or in one combustion chamber provided with two burners, i.e. with an off-gas burner and a liquid residue burner, respectively.

However, the quantities of off-gas which are passed from a production plant to an incinerator are liable to be irregular, and the irregularities have adverse effects on the liquid residue burners, which are correspondingly irregularly charged with liquid residue and in the end will become clogged. To avoid this disadvantage and to provide for a uniform load capacity to the burner and combustion chamber, it is an object of the present invention to provide for off-gases and liquid residues to be jointly incinerated in a special burner; for the quantity of liquid residue coming from a reservoir to be controlled, by utilizing the combustion chamber temperature, according to the quantity and reaction enthalpy of the burning off-gases; and for the rate of admission of the combustion air to be regulated, preferably according to the oxygen-content of the combustion gases leaving the combustion chamber.

The off-gases with which we are concerned contain chlorinated hydrocarbons in admixture with various proportions of other combustible (i.e. oxygen-consuming) gases and incombustible (i.e. inert) gases, e.g. nitrogen. By employing means for ascertaining the combustion chamber temperature, and by employing an oxygen-analyzer, the supply of liquid residue or combustion air can be controlled, in a process in accordance with the present invention, so that the apparatus employed can have a uniform loading in respect of energy and comsumption of oxygen or air, and a uniform output of hydrogen chloride. In a process in accordance with the present invention, an incinerator system can be programmed for the maximum quantity of off-gas coming from the respective commercial plant, so that it is possible for varying quantities of liquid residue, drawn from a reservoir thereof, to be incinerated when the system is under a normal or sub-normal load. According to the present invention, we provide a process for the joint combustion of off-gases and liquid residues containing chlorinated hydrocarbons, which comprises forming a mist comprising a mixture of off-gases and atomised liquid residues, the latter being atomised by means of air and/or steam, and directing this mist into a preheated combustion chamber lined with refractory bricks, the said mixture being introduced into the combustion chamber jointly with combustion air through a burner having four feed pipes arranged coaxially with respect to each other and terminating in conically tapered outlets, the three outer feed pipes defining three separate and coaxial annular zones around the innermost feed pipe; the quantity of liquid residue fed in and burnt being sufficient to maintain in the combustion chamber a predetermined maximum temperature which is not above the range 1200° to 1800° C, and which is compatible with the refractory properties of the brick lining of the combustion chamber; withdrawing the resulting hot combustion gases from the combustion chamber, quenching these combustion gases with water, and recovering hydrochloric acid from the aqueous solution resulting from the quenching of the combustion gases.

Preferred features of the present invention provide:

a. for the liquid residues to be admitted through the innermost feed pipe, for air and/or steam as the atomizing agent to be admitted through the first (counted from the interior towards the outside) annular zone, for the combustion air to be admitted through the second annular zone, and for the off-gases to be admitted through the third or outermost annular zone of the burner, all being admitted to the combustion chamber;

b. for the quantity of liquid residues admitted to the combustion chamber to be controlled, by means comprising a thermocouple, in accordance with the temperatures prevailing in the combustion chamber;

c. for the liquid residues to be atomized by means of 1–5 $m^3$ (S.T.P) of air and/or 0.2–2 kg of steam per kg of liquid residue;

d. for the quantity of combustion air admitted to the combustion chamber to be controlled, by means comprising an oxygen-analyzer, in accordance with the oxygen-content of the combustion gases leaving the combustion chamber;

e. for the off-gases employed to contain 0.1–1 $kg/m^3$ of chlorine;

f. for the liquid residues employed to contain 1 to 75 weight % of chlorine;

g. for the off-gases to be admixed with hydrogen or methane as a combustion gas, or with nitrogen as a diluting gas, according to the combustibility of the off-gases and liquid residues; and h. for the preheating of the combustion chamber to be effected by means of an ignited mixture of hydrogen and combustion air.

BRIEF DESCRIPTION OF THE DRAWINGS

The invention will now be described in more detail with reference to the accompanying diagrammatic drawings, in which:

The burner shown in FIG. 1 has an annular end plate 1 secured, e.g. by means of bolts or screws, to an annular supporting frame 2 fixed around a circular aperture in the brickwork 3 of a combustion chamber. As shown in FIG. 1, the passage afforded by this frame and the said aperture widens conically towards the interior of the combustion chamber. The burner is made up of four feed pipes of different length and width which are arranged coaxially to each other. The innermost feed pipe 4 serves to introduce a liquid residue, which is atomized by means of air and/or steam admitted through an annular shell 5 which is provided with an inlet opening laterally thereinto. The annular shell 5 in turn is surrounded by an annular shell 6, also provided with a lateral inlet, for the admission of combustion air. The downstream portion of the annular shell 6 is surrounded by an outermost annular shell 7, which is provided with a lateral inlet for the introduction of off-gas. If necessary, it is possible to use the outermost annular shell 7 for the supply, at the start of the reaction, of an igniting gas, e.g. hydrogen or methane and during the reaction, for the supply of nitrogen or steam as a diluting gas. Steam supports the combustion; however it absorbs heat and acts as a coolant. The downstream end portions of the two annular shells 5 and 6 have baffle plates 8 and 9, respectively, inserted therein. Each of the annular shells 5, 6 and 7 terminates in an outlet which is conically tapered inwardly, i.e. the three chambers have conically reduced downstream ends, similar to a nozzle.

The arrangement described permits the off-gas, liquid residue and combustion air to be mixed together so as to form a mist.

Figure 1:
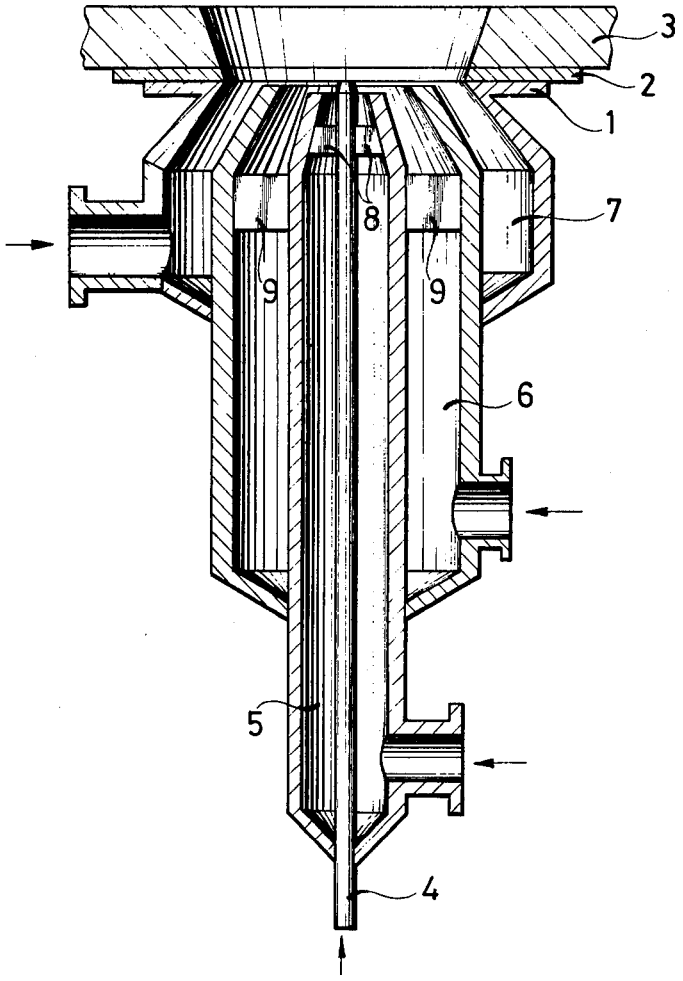
FIG. 1 is a view in axial section showing a burner for use in accordance with the invention.
Figure 2:
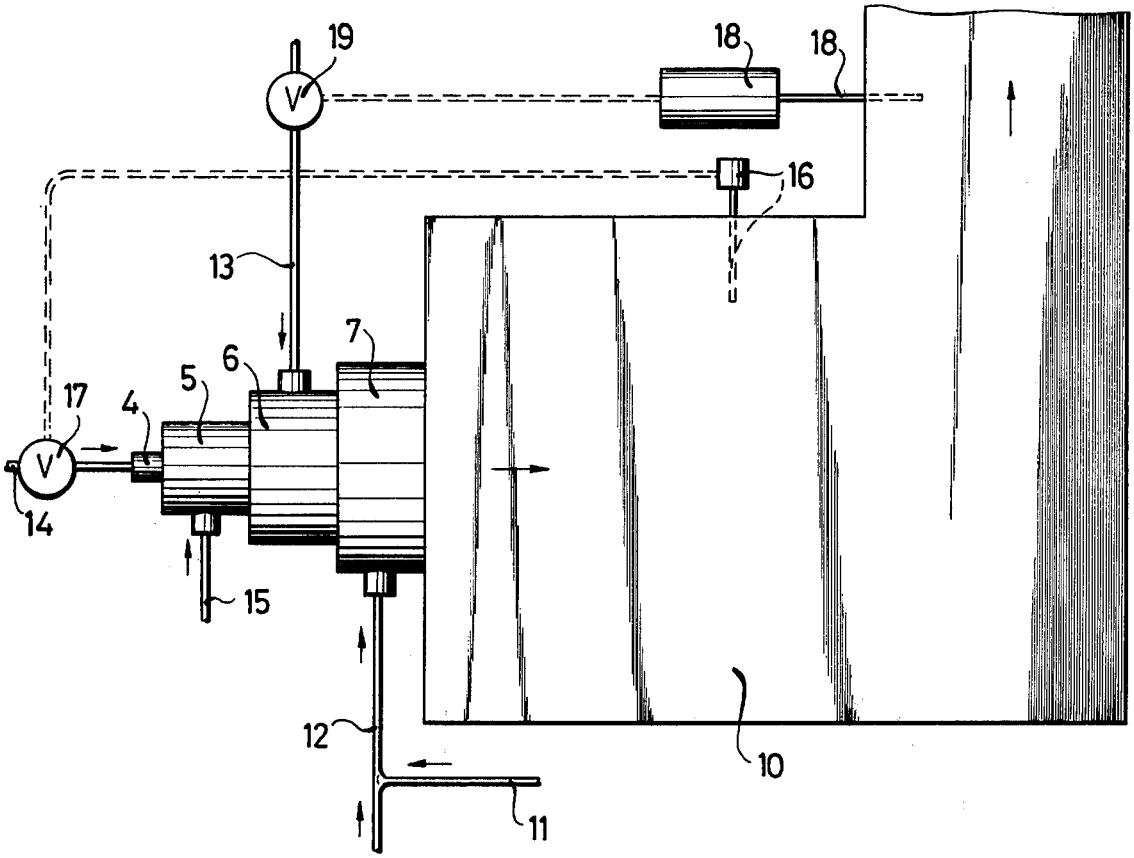
FIG. 2 is a side view of a combustion apparatus incorporating the burner of FIG. 1.

As shown in FIG. 2, the burner (comprising components 4, 5, 6 and 7) is connected to a combustion chamber 10. The functioning of the burner is as described with reference to FIG. 1 above. By means of conduits 11 and 12, the combustion chamber 10 is scavenged initially with nitrogen and later with air. Next, an igniting gas, e.g. hydrogen, is introduced into the combustion chamber 10 through the conduits 11 and 12. Combustion air is supplied through a conduit 13. As soon as, after ignition of the gas mixture, the minimum temperature of approximately 900° C necessary for the combustion of off-gases containing chlorinated hydrocarbons has been reached in the combustion chamber 10, off-gas is gradually admitted through the conduit 12 and the supply of igniting gas is reduced. Once the minimum temperature of approximately 1100° C necessary for the combustion of liquid residues containing chlorinated hydrocarbons has been reached, liquid residue is introduced through a conduit 14 together with air or steam as its atomizing agent, which is supplied through a conduit 15. The quantity of liquid residue admitted is controlled according to the combustion chamber temperature by means of a thermocouple 16 and a valve 17. The maximum temperature allowable for a normal brick-lined combustion chamber is 1400° C. The quantity of combustion air admitted through the conduit 13 is controlled, by means of an oxygen-analyzer 18 and a valve 19, according to the oxygen content of the combustion gases leaving the combustion chamber 10. The precipitation of carbon black and the liberation of chlorine can be obviated generally by the use of oxygen in a slight stoichiometric excess of 1–2%, or air in an excess of 5–10%.

The following Example further illustrates the invention.

EXAMPLE 200 normal $m^3/h$ (S.T.P.) of an off-gas containing chlorinated hydrocarbons with a chlorine content of 0.17 kg per normal $m^3$ (composition in % by volume: ethylene: 7.8; ethane: 1.0; methane: 0.2; dichloroethane: 4.0; ethyl chloride: 2.0; HCl: 0.6; oxygen: 3.4; inert gases ($N_2$,$CO_2$): 81.0), and with a calorific value of 2080 kcal/-normal $m^3$ (total calorific value = 2080 × 200 = 416000 kcal), were subjected to combustion in the combustion chamber 10 of FIG. 2. The combustion chamber used was lined with refractory bricks of high alumina content (softening point = 1855° C) (Seger cone No. 38); permissible operating temperature = 1550° C). At a temperature not exceeding 1400° C, it was possible to burn in the combustion chamber 10, at the same time as the off-gas, 226 kg/h of liquid chlorinated hydrocarbon residue (C: 45.5 weight%; H 6.5 weight%; Cl: 48 weight%) with a calorific value of 5250 kcal/kg (total calorific value = 5250 × 226 = 1186500 kcal). In other words, the combustion chamber permitted the combustion of substances with a total calorific value of 416000 kcal/h + 1186500 kcal/h, i.e. approximately $1.6 \times 10^6$ kcal/h). The quantity of off-gas was taken as the reference magnitude and the quantity of liquid was the regulated magnitude, being controlled according to the temperature prevailing in the combustion chamber. The 226 kg/h of liquid residue was atomized by means of 450 normal $m^3/h$ of air and 90 kg/h of steam, which were admitted through the conduit 15 and annular shell 5. A further 1350 normal $m^3/h$ of combustion air was admitted through the conduit 13 and annular shell 6. This corresponded to a 7% by volume excess of air, or a 1.4% by volume excess of oxygen.

2250 normal $m^3/h$ of combustion gas containing hydrogen chloride (having the following composition in % by volume: inert gases ($N_2$,$CO_2$): 82; HCl: 4.0; steam: 13; oxygen: 1) left the combustion chamber, being delivered at an approximate temperature of 1000° C to a quenching zone and being quenched therein with circulating hydrochloric acid so as to bring the temperature down to 60° C.

The 200 normal $m^3/h$ of off-gas and 226 kg/h of liquid residue used contained 142 kg/h or mostly chemically combined chlorine. After combustion, they gave 146 kg/h of hydrogen chloride, which was absorbed in 340 kg/h of water with the resultant formation of hydrochloric acid having an approximate strength of 30 weight %.

We claim:

1. A process for the joint combustion of off-gases and liquid residues containing chlorinated hydrocarbons, which comprises forming a mist comprising a mixture of off-gases and atomised liquid residues, the latter being atomised by means of at least one of air or steam, and directing this mist into a preheated combustion chamber lined with refractory bricks, the said mixture being introduced into the combustion chamber jointly with combustion air through a burner having four feed pipes arranged coaxially with respect to each other and terminating in conically tapered outlets, the three outer feed pipes defining three separate and coaxial annular zones around the innermost feed pipe; the quantity of liquid residue fed in and burned being sufficient to maintain in the combustion chamber a predetermined maximum temperature which is not above the range 1200° to 1800° C, and which is compatible with the refractory properties of the brick lining of the combustion chamber; withdrawing the resulting hot combustion gases from the combustion chamber, quenching these combustion gases with water, and recovering hydrochloric acid from the aqueous solution resulting from the quenching of the combustion gases.

2. A process as claimed in claim 1, wherein the liquid residues are admitted through the innermost feed pipe, as the atomizing agent at least one of air or steam admitted through the first annular zone, the combustion air is admitted through the second annular zone, and the off-gases are admitted through the third annular shell zone, all being admitted to the combustion chamber.

3. A process as claimed in claim 1, wherein the quantity of liquid residues admitted to the combustion chamber is controlled, by means comprising a thermocouple, in accordance with the temperatures prevailing in the combustion chamber.

4. A process as claimed in claim 1, wherein the liquid residues are atomized by means of 1–5 $m^3$ (S.T.P.) of air and/or 0.2–2 kg of steam per kg of liquid residue.

5. A process as claimed in claim 1, wherein the quantity of combustion air admitted to the combustion chamber is controlled, by means comprising an oxygen-analyzer, in accordance with the oxygen-content of the combustion gases leaving the combustion chamber.

6. A process as claimed in claim 1, wherein the off-gases employed contain 0.1–1 $kg/m^3$ of chlorine.

7. A process as claimed in claim 1, wherein the liquid residues employed contain 1 to 75 weight% of chlorine.

8. A process as claimed in claim 1, wherein the off-gases are admixed with hydrogen or methane as a combustion gas, or with nitrogen as a diluting gas, according to the combustibility of the off-gases and liquid residues.

9. A process as claimed in claim 1, wherein the preheating of the combustion chamber is effected by means of an ignited mixture of hydrogen and combustion air.

* * * * *